US005269040A

United States Patent [19]

Switall

[11] Patent Number: 5,269,040

[45] Date of Patent: Dec. 14, 1993

[54] BRUSH

[76] Inventor: Jeff Switall, 20805 Middleton Dr., Kildeer, Ill. 60047

[21] Appl. No.: 653,189

[22] Filed: Feb. 11, 1991

[51] Int. Cl.[5] ..... A47K 7/02

[52] U.S. Cl. ..... 15/244.1; 15/187

[58] Field of Search ..... 15/159 A, 244.1, 244.2, 15/244.4, 187, 188, 167.1

[56] References Cited

U.S. PATENT DOCUMENTS

| | | | |
|---|---|---|---|
| 1,058,273 | 4/1913 | Thompson | 15/188 |
| 1,708,050 | 4/1929 | Burlew | 15/188 |
| 1,936,174 | 11/1933 | Renschin | 15/188 |
| 1,963,360 | 6/1934 | Gibbin et al. | 15/188 |
| 2,018,903 | 10/1935 | Stevens | 15/188 |
| 2,225,331 | 12/1940 | Campbell | 15/188 |
| 2,316,878 | 4/1943 | Mandalou | 15/244.1 |
| 2,555,858 | 6/1951 | Oleksy | 15/244.1 |
| 2,602,948 | 7/1952 | Kautenberg | 15/244.1 |
| 2,764,773 | 10/1956 | Glanvill et al. | 15/188 |
| 2,845,648 | 8/1958 | Peterson | 15/188 |
| 2,944,273 | 7/1960 | Harris | 15/188 |
| 2,946,074 | 7/1960 | Caldwell | 15/244.1 |
| 3,058,139 | 10/1962 | Dryden | 15/244.1 |
| 3,105,263 | 10/1963 | Ginter | 15/244.1 |
| 3,228,398 | 1/1966 | Leonard et al. | 15/244.1 |
| 3,327,339 | 6/1967 | Lemelson | 15/244.1 |
| 3,447,181 | 6/1969 | Coker et al. | 15/244.1 |
| 4,263,691 | 4/1981 | Pakarnseree | 15/159 A |
| 4,685,423 | 8/1987 | Baker et al. | 15/159 A |
| 4,830,674 | 5/1989 | Kaufman | 15/244.1 |

*Primary Examiner*—Harvey C. Hornsby
*Assistant Examiner*—Reginald L. Alexander
*Attorney, Agent, or Firm*—Lee, Mann, Smith, McWilliams, Sweeney & Ohlson

[57] ABSTRACT

A brush is disclosed which is adapted to retain a substantial quantity of liquid such as water for scrubbing articles such as wire wheels of an automobile. The brush has a pad with bristles extending upwardly therefrom, each of the bristles consisting of a resilient, tapered, finger-like core member attached to the pad, and surrounding and attached to each case member is an outer covering member formed of a soft, resilient, sponge-like material, such as sponge rubber. The outer covering member is capable of absorbing and holding substantial quantities of water or other liquid and of desorbing that liquid when compressed as between the relatively stiff core and the article being scrubbed. The stiff core members hold the sponge-like covering members in firm contact with the surface of the article being scrubbed.

7 Claims, 1 Drawing Sheet

BRUSH

BACKGROUND OF THE INVENTION

This application is directed to a brush and more particularly, to a very soft brush in which the bristles or scrubbing elements will hold substantial quantities of liquid such as water and any desired scrubbing compounds. The brush is particularly adapted to clean hard to reach areas as between the spokes of wire automobile wheels.

When cleaning hard to reach places such as between the spokes of wire automobile wheels, the present cleaning brushes have disadvantages. While the bristles of prior art brushes will hold some water, the amount of water held is not very much and any solid or liquid cleaning compound which is applied to the bristles is easily knocked off. Moreover, if the bristles are too hard they will scratch the surface being cleaned and it is difficult for them to reach into the recesses and interstices in order to do an acceptable cleaning job. Over the years a number of attempts have been made to make the bristles out of various materials including rubber or plastic or stiff wire coated with rubber or plastic. The trouble with these types of brushes is that none will really not hold water or other cleaning liquid and they are not soft so that they may bend around odd-shaped articles and extend into crevices.

It is the object of this invention to provide a brush which has soft, absorbent bristles or tines which will hold water and scrubbing compound for cleaning area surfaces including those having irregularities and difficult to reach interstices and yet which have a sufficient stiffness to accomplish a scrubbing action.

SUMMARY OF THE INVENTION

In accordance with this invention, a brush is provided which is adapted to retain a substantial quantity of a liquid, such as water for scrubbing articles. The brush includes a pad having a plurality of bristles, each bristle comprising a resilient, finger-like core member attached to and extending outwardly from the pad. An outer covering member formed of a soft, resilient, sponge-like material surrounds and is attached to each core member. The covering member is capable of absorbing and holding a liquid such as water and of desorbing that liquid, i.e. of having a liquid squeezed therefrom, when compressed. Thus the stiff underlying core members will hold the sponge-like covering members in contact with the surface of the article being scrubbed and the absorbed liquid will be desorbed as the covering members are compressed against the cores. It is preferred that the pad and the fingers are molded of rubber and are integral and that the covering member totally encases the core to which it is attached so that only the covering member will engage the surface of the article being scrubbed. The covering material from which the covering member is formed is preferably a foam rubber having an open cellular structure. The core members are preferably outwardly tapered which makes them more resilient at their outer ends and at the same time permits a greater thickness of the covering member at the outer edges of the bristles. This permits a greater amount of water or liquid or other liquid to be held at the outer ends of the bristles or tines.

DETAILED DESCRIPTION OF THE PREFERRED EMBODIMENT

Figure 1:
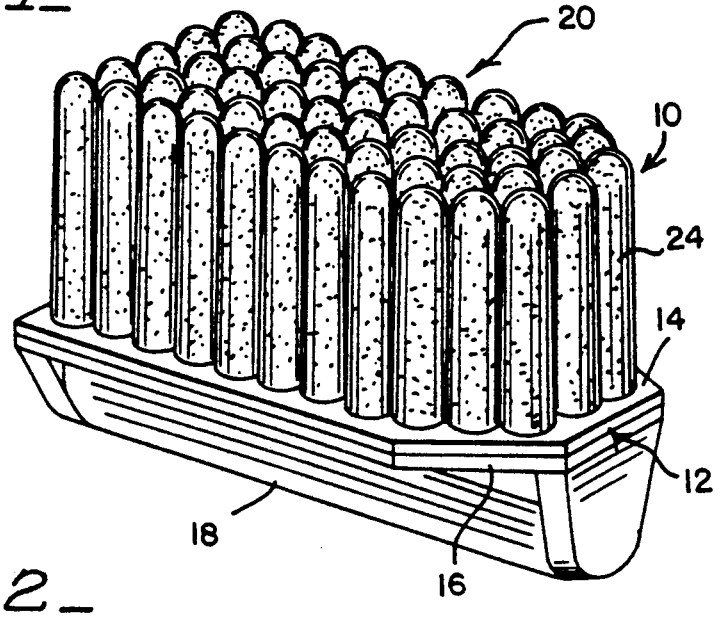
FIG. 1 is a perspective view showing a brush constructed in accordance with this invention.
Figure 2:
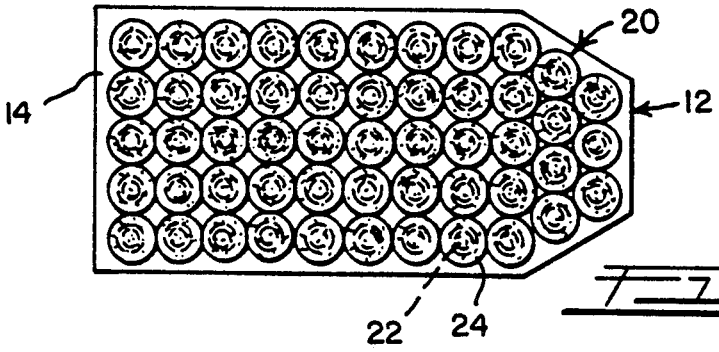
FIG. 2 is a top plan view of the brush shown in FIG. 1.

With further reference to the drawings in FIG. 1 there is shown a brush 10 having a support or pad 12 which has a flat upper surface 14 and the bottom of which is attached to a base 16. Attached to and preferably integral with the base 16 is a handle 18 which extends the length of the base. Extending upwardly from the flat upper surface 14 of the support pad 12 are a plurality of bristles or tines 20. Each bristle or tine 20 consists of a stiff, yet somewhat flexible, resilient, finger-like core member 22 which is firmly attached to and is preferably integral with the pad 12 and extends outwardly from the upper surface 14 of the pad substantially perpendicularly from that upper surface. Since the upper surface 14 is flat in the illustrated embodiment, the illustrated core members 22 extend upwardly substantially parallel to one another.

Figure 4:
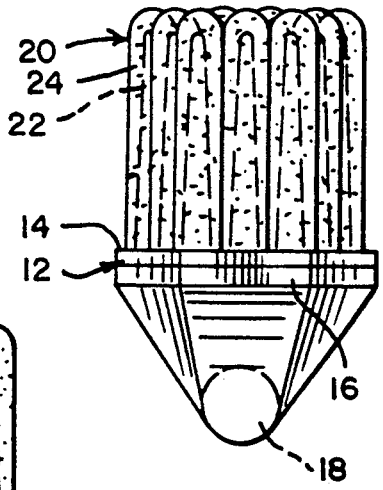
FIG. 4 is a front elevational view of the brush.
Figure 3:
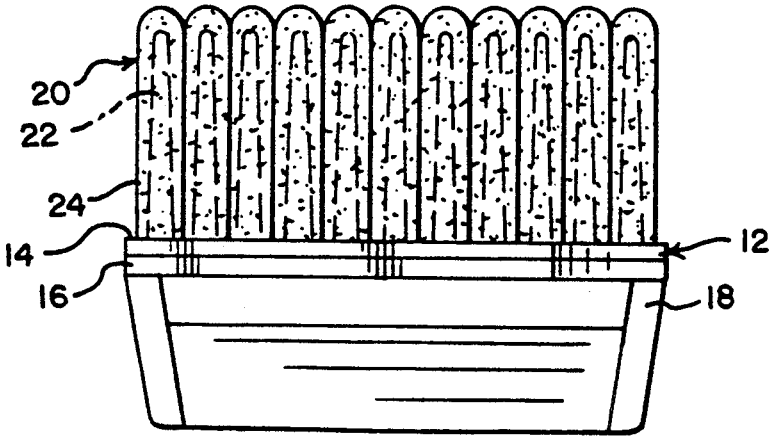
FIG. 3 is a side elevation view of the brush.

The core members 22 and preferably the support pad 12 are formed of an elastomeric material, which in the preferred embodiment is molded hard rubber as may be best seen in FIGS. 3 and 4. The material forming the core members may be similar to a tire rubber and preferably has a durometer hardness in the range of 45–55 on the Shore A scale. The core members are thus able to flex somewhat, yet have the necessary degree of stiffness to achieve scrubbing as will be more fully described. The core members 22 are slender and substantially conical in shape, being outwardly tapered, that is, tapered toward their outer ends so that they have greater flexibility at their outer ends and greater stiffness adjacent the support pad 12. The core members should be stiff but relatively resilient, although the degree of stiffness may vary according to the desired use of the brush. The stiffness may be varied by the selection of material, by the thickness and by the degree of tapering.

Attached to each of the core members 22 is an outer covering member 24 formed of a soft, resilient, sponge-like material which is capable of absorbing and holding a substantial amount of a liquid such as water. It is preferred that the material from which the covering member is made is foam rubber having an open cellular structure. The foam rubber may be a foamed natural rubber or it may be a foamed synthetic rubber, or a foamed polyurethane, or any other elastomeric material which has soft, very flexible and resilient sponge-like characteristics with an open cellular structure. The material of the covering members 24 should be capable of absorbing substantial quantities of water so that the water can be brought into contact with the article being scrubbed by the brush.

It will be seen that in the preferred embodiment the outer surfaces of the covering members 24 are substantially cylindrical and they are very closely packed, preferably engaging one another. Since the core members 22 are tapered toward their outer ends, the thickness of the material of the covering members 24 is greater at the outer ends. In other words there is more of the absorbent sponge material at the outer ends of the bristles or tines 20 than there is adjacent the support or pad 12. Preferably the thickness of material of the covering members 24 at the outer end of the bristle is at least as great as the diameter of the core member at the outer end of the bristle. As a result of this, there is more absorbency and a greater amount of water can be held at the outer ends of the bristles or tines 20. Thus the water or other cleaning liquid together with any scrubbing compound will be contained at the outer ends of the brush for contact with the article being scrubbed.

The stiff, resilient, finger-like core members 22 serve to give the bristles or tines 20 a degree of inner or core stiffness. At the same time each bristle or tine has a degree of softness and resiliency as a result of the sponge-like covering members 24. Thus, the relatively stiff underlying core members 22 will hold the sponge-like covering members 24 in contact with the surface of the article being scrubbed and the absorbed liquid will be desorbed or squeezed out of the sponge-like covering members 24 as these covering members are compressed against the core members 22.

The soft, resilient character of the outer covering members 24 and the tapering ends on the core members 22 also permits the bristles or tines 20 to enter into the interstices of the article being scrubbed. For example, in the case of a wire wheel of an automobile, the fingers easily reach into and resiliently expand behind the wire spokes. The water which is absorbed on the ends of the bristles or tines 20, carrying whatever scrubbing compound may be desired along with it, will be carried to those hard to reach places of the article and clean these thoroughly.

The handle 18 preferably is formed of a hard plastic and may be adhesively or otherwise suitable attached to the pad 12. The disposed handle 18 is below the pad supporting the bristles or tines 20 because with this brush the scrubbing and cleaning action is both parallel to the bristles or tines 20 and lateral. In scrubbing a wire automobile wheel the tines are pushed into the spaces between the wire spokes and the scrubbing action will be almost entirely in the direction of the bristles themselves rather than laterally. It will be understood, however, that in some applications it may be more desirable to have a handle which extends laterally outwardly from the pad 12 rather than totally disposed under the pad as in the illustrated embodiment.

The foregoing detailed description has been given only by way of example and it will be understood by those skilled in the art that many modifications may be made in the structure of the illustrated and described preferred embodiment without departing from the spirit and scope of the invention as herein after claimed.

What is claimed is:

1. A brush adapted to retain a substantial quantity of a liquid for scrubbing articles, said brush including: a pad; and a plurality of bristles, each bristle comprising a finger-like core member attached to and extending outwardly from said pad; and an outer covering member formed of a soft, resilient material surrounding and attached to each core member whereby only said covering members will engage the surface of the article being scrubbed, said core members being formed of an elastomeric material and being relatively stiff compared to the material of said covering member, said covering member material having an open cellular structure capable of absorbing and holding a liquid and of desorbing that members being formed of an elastomeric material and being relatively stiff compared to the material of said covering member, said covering member material having an open cellular structure capable of absorbing and holding a liquid and of desorbing that liquid when compressed, whereby the stiff underlying core members will hold the covering members in contact with the surface of the article being scrubbed and the absorbed liquid will be desorbed as the covering members are compressed against the underlying relatively stiff core members.

2. The structure of claim 1 wherein said pad and said core members are molded integrally.

3. The structure of claim 1 wherein said material from which said covering member is made is foam rubber having an open cellular structure.

4. The structure of claim 1 wherein said core members are outwardly tapered, whereby the outer ends will have greater flexibility.

5. The structure of claim 4 wherein the thickness of the covering member material at the outer end of the core member is at least as great as the core member.

6. The structure of claim 1 wherein said bristles are closely packed with the outer covering member of adjacent bristles are closely adjacent one another.

7. A brush adapted to retain a substantial quantity of a liquid for scrubbing articles, said brush including: a pad; and a plurality of bristles, each bristle comprising an elongated and outwardly tapered core member attached to and extending outwardly from said pad, whereby the outer ends of said core members will be thinner and have greater flexibility than the inner ends, and a substantially cylindrical outer covering member formed of a soft, resilient, absorbent material surrounding and attached to each core member, whereby the thickness of the absorbent covering member material and the liquid holding capacity of each bristle is greatest at the outer ends of the bristles and only said covering members will engage the surface of the article being scrubbed, said core members being formed of an elastomeric material and being relatively stiff compared to the material of said covering member, said covering member material having an open cellular structure capable of absorbing and holding a liquid and of desorbing that liquid when compressed, whereby the stiff underlying core members will hold the absorbent covering members in contact with the surface of the article being scrubbed and the absorbed liquid which will be concentrated at the outer ends of the bristles will be desorbed as the covering members are compressed against the underlying relatively stiff core members.

* * * * *